United States Patent [19]

Bernarducci

[11] Patent Number: 4,804,492

[45] Date of Patent: Feb. 14, 1989

[54] LIQUID SANITIZING AND CLEANING COMPOSITIONS WITH DIMINISHED SKIN IRRITANCY

[75] Inventor: Ernest Bernarducci, Rutherford, N.J.

[73] Assignee: Sterling Drug Inc., New York, N.Y.

[21] Appl. No.: 133,770

[22] Filed: Dec. 16, 1987

Related U.S. Application Data

[63] Continuation of Ser. No. 928,211, Nov. 7, 1986, abandoned.

[51] Int. Cl.[4] ..... C11D 1/62; C11D 1/835; C11D 3/48

[52] U.S. Cl. ..... 252/106; 252/174.21; 252/547; 252/DIG. 5; 252/DIG. 14; 514/642; 514/643

[58] Field of Search ..... 252/106, 547, DIG. 5, 252/DIG. 14, 174.21; 514/642, 643

[56] References Cited

U.S. PATENT DOCUMENTS

| | | | |
|---|---|---|---|
| 2,108,765 | 2/1938 | Domagk | 167/30 |
| 2,689,814 | 9/1954 | Nicholls et al. | 514/643 |
| 3,223,643 | 12/1965 | Law | 514/643 |
| 3,361,794 | 1/1968 | Wakeman et al. | 260/501.15 |
| 3,956,402 | 5/1976 | Schellenbaum | 252/106 |
| 4,021,537 | 5/1977 | Saurino | 514/493 |
| 4,203,872 | 5/1980 | Flanagan | 252/106 |
| 4,272,395 | 6/1981 | Wright | 252/547 |
| 4,323,468 | 4/1982 | Grollier et al. | 252/DIG. 5 |
| 4,661,289 | 4/1987 | Parslow et al. | 252/8.8 |

FOREIGN PATENT DOCUMENTS 2458280 2/1981 France .

OTHER PUBLICATIONS

CTFA *Cosmetic Ingredient Dictionary*, CFTA Washington D.C. 1984 p. 200.

Japanese Patent Document 58/76579, 5/9/1983 (Derwent Abstract).

Japanese Patent Document 57/106612, 7/2/1982 (Derwent Abstract).

Brody et al., J. Am. Chem. Soc. 106, 4279–4280 (1984).

Campanella et al. Rev. of Roum. Chim. 27(5) 681–683 (1982) (Chem. Abs., 98 83039s (1983)).

*Primary Examiner*—Paul Lieberman

*Assistant Examiner*—Linda D. Skaling

*Attorney, Agent, or Firm*—William G. Webb; Paul E. Dupont

[57] ABSTRACT

Liquid sanitizing and cleaning compositions with diminished skin irritancy comprise a nonionic surfactant and a di-(lower-alkyl)-long-chain-alkylbenzylammonium benzoate or a di-(lower-alkyl)-di-(long-chain-alkyl)-ammonium benzoate, the latter being produced either by ion exchange of the corresponding quaternary ammonium halide with benzoate or by mixing the quaternary ammonium halide with at least about one molar equivalent of an alkali metal benzoate, in water.

15 Claims, No Drawings

LIQUID SANITIZING AND CLEANING COMPOSITIONS WITH DIMINISHED SKIN IRRITANCY

This application is a continuation of application Ser. No. 928,211, filed Nov. 7, 1986, now abandoned.

BACKGROUND OF THE INVENTION

This invention relates to quaternary ammonium salt-containing liquid sanitizing and cleaning compositions having diminished skin irritancy.

INFORMATION DISCLOSURE STATEMENT

Quaternary ammonium salts, particularly quaternary ammonium salts of the di-(lower-alkyl)-long-chain-alkyl-benzylammonium halide and the di-(lower-alkyl)-di-(long-chain-alkyl)ammonium halide types, are of course well known in the prior art as is the use of such quaternary ammonium halides, either alone or in combination with surfactants, in bactericidal applications, such as in sanitizing and cleaning compositions.

Koulbanis et al. French Pat. No. 2,458,820, published Feb. 6, 1981, discloses compositions for removing make-up from the eyes comprising an aqueous solution of at least one surfactant selected from polyethoxylated esters of $C_{12}$–$C_{18}$ fatty acids and glycerol, at least one preservative selected from a group of four which includes a mixture of 30% sodium benzoate and 70% monochloracetamide, a dimethylbenzylalkylammonium chloride and a phosphate buffer, the compositions having a pH of 6.5–7.5. The reference specifically discloses "myristyl cetyl dimethyl benzyl ammonium" chloride as a quaternary. The compositions are stated not to sting or irritate.

Japanese Pat. Document No. 58/76579, published May 9, 1983 [abstracted at Derwent Japanese Patents Gazette, page 16, Sect. D, Week K24, 1983], discloses a deodorant for feathers containing a quaternary ammonium or alkyl pyridinium salt type cationic surfactant and an organic carboxylic acid in the ratio of 1:9 to 9:1. The quaternary ammonium salt is selected from a group of five classes, including a dimethylbenzyl ($C_8$–$C_{22}$)-alkylammonium halide, where alkyl is, for example, lauryl, myristyl or cetyl; and the organic carboxylic acid is selected from a group of ten, including benzoic acids.

Japanese Pat. Document No. 57/106612, published July 2, 1982 [abstracted at Derwent Japanese Patents Gazette, page 3, Sect. B, Week E32, 1982], discloses a turbidity-free eye lotion prepared by adding a water-soluble salt (0.02–0.3 w/v%) to an eye lotion comprising a glycyrrhizinic acid salt (0.02–0.2 w/v%) and a cationic surfactant (0.002–0.02 w/v%). As water soluble salt and cationic surfactant there are disclosed, inter alia, sodium benzoate and benzalkonium chloride, respectively. The eye lotion is stated to cause little irritation to the eyes.

Wakeman et al. U.S. Pat. No. 3,361,794, patented Jan. 2, 1968, discloses microbiologically active "relatively water-insoluble" quaternary ammonium compounds having the formula $[R'R''N(CH_3)_2]^+[RZCOO]^-$ where: "R' is an alkyl radical containing from 8 to 22 carbon atoms, an alkyl benzyl radical in which the benzyl group may contain a substituent methyl radical and in which the alkyl group contains 8 to 22 carbon atoms, or an alkyl phenoxy ethoxy ethyl radical in which the phenyl group may contain a substituent methyl radical and R'' is a benzyl or substituted benzyl radical, or a methyl group if R' is an alkyl benzyl radical containing eight or more carbon atoms in its alkyl substituent". The compounds are prepared by reaction of the corresponding quaternary ammonium hydroxides or water-soluble salts with a carboxylic acid, $RZCO_2H$, where "R is a mono- or poly-alkyl substituted benzene or naphthalene nucleus, or the substituted nucleus of diphenyl or diphenyl oxide in each of which cases the substituents may be radicals having from 1 to 22 carbon atoms, and Z is $(CH_2)_n$ or $(CH_2)_n-2H$ where n is any number from zero to four". Specific compounds disclosed include alkyl- (50% $C_{12}$, 30% $C_{14}$, 17% $C_{16}$, 3% $C_{18}$) dimethylbenzylammonium p-(and m-) toluate. The compounds are disclosed to be especially appropriate for a wide variety of specifically identified applications, including application as additives for anionic and nonionic detergents in liquid and solution form.

Domagk U.S. Pat. No. 2,108,765, patented Feb. 15, 1938, discloses quaternary ammonium compounds having at least one high molecular weight aliphatic hydrocarbon radical as the substituent on the nitrogen atom and having bactericidal and fungicidal properties. Among compounds specifically enumerated are dimethyldecylbenzylammonium chloride, dimethyldodecylbenzylammonium cyanide and dimethyltridecylbenzylammonium chloride. It is stated that other salts may be employed, including benzoates, but no quaternary ammonium benzoates are either specifically named or exemplified. It is also stated that the compositions used for disinfection "do not injure the skin and therefore may also be used for the disinfection of the skin, particularly the hands".

Brady et al., J. Am. Chem. Soc. 106, 4279–4280 (1984) disclose a study of the effects of a variety of didodecyldimethylammonium carboxylate salts, including the benzoate, as surfactants to promote the spontaneous formation of lipid vesicles.

Campanella et al., Rev. of Roum. Chim. 27(5), 681–683 (1982) [Chem. Abstr. 98, 83039s (1983)] discloses a liquid membrane electrode for benzoic acid determination containing dimethyldicetylammonium benzoate and benzyldimethylcetylammonium benzoate.

I have surprisingly found that use of certain quaternary ammonium benzoates in aqueous sanitizing and cleaning compositions containing a nonionic surfactant have greatly diminished skin irritancy as compared with compositions containing the corresponding quaternary ammonium halides.

SUMMARY OF THE INVENTION

More specifically, in a composition aspect the invention resides in liquid sanitizing and cleaning compositions comprising a di-(lower-alkyl)-long-chain-alkyl-benzylammonium benzoate and/or a di-(lower-alkyl)-di-(long-chain-alkyl)ammonium benzoate in combination with a nonionic surfactant of the straight chain alkylethoxylate, secondary alkylethoxylate or alkylphenolethoxylate classes in water.

In a method aspect the invention resides in a method of diminishing skin irritancy in liquid sanitizing and cleaning compositions containing a di-(lower-alkyl-long-chain-alkylbenzylammonium halide and/or a di-(lower-alkyl)-di-(long-chain-alkyl)ammonium halide in combination with a nonionic surfactant of the straight-chain alkylethoxylate, secondary alkylethoxylate or alkylphenolethoxylate classes in an aqueous medium which comprises incorporating in such compositions from about one to about two molar equivalents, relative to the quaternary ammonium halide, of an alkali metal benzoate.

DETAILED DESCRIPTION OF THE PREFERRED EMBODIMENTS

In accordance with the foregoing, the sanitizing and cleaning compositions of the invention comprise:

(A) a quaternary ammonium benzoate of the formula:

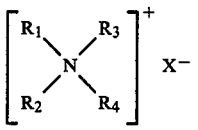

I where $R_1$ and $R_2$ are lower-alkyl groups containing from 1 to 3 carbon atoms;

$R_3$ is $C_8$–$C_{16}$ alkyl;

$R_4$ is $C_8$–$C_{16}$ alkyl or benzyl; and $X^-$ is the benzoate anion;

(B) a non-ionic surfactant selected from the group consisting of an alkylphenolethoxylate of the formula:

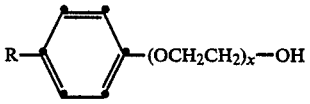

II where is $C_8$–$C_9$ alkyl, and x is an integer from 7 to 13 and indicates the average number of $(OCH_2CH_2)$ units in the side chain, and a straight-chain alkylethoxylate or a secondary alkylethoxylate of the formula:

$$H—(OCH_2CH_2)_nOR_5 \quad \text{(III)}$$

where $R_5$ is $C_{14}$–$CH_{15}$ alkyl and n is an integer from 7 to 13; and (C) water.

The di-(lower-alkyl)-long-chain-alkylbenzylammonium benzoates or di-(lower-alkyl)-di-(long-chain-alkyl)ammonium benzoates of formula I can be prepared by ion exchange with the corresponding quaternary ammonium halide ($X^-$ is halide). However, the preparation of the quaternary ammonium benzoate in situ by addition to an aqueous solution of the quaternay ammonium halide of about one molar equivalent of an alkali metal benzoate per mole of quaternary ammonium halide is economically more feasible, and accordingly, in a preferred method, the compositions are prepared, in accordance with a process with a process to be described hereinafter, by mixing aqueous solutions of the quaternary ammonium halide and an alkali metal benzoate to produce the quaternary ammonium benzoate in situ.

Accordingly, the compositions of the invention can also be defined as comprising: (A) a di-(lower-alkyl)-long-chain-alkylbenzylammonium halide or a di-(lower-alkyl)-di-(long-chain-alkyl)ammonium halide of formula I, where $X^-$ is halide, (B) a nonionic surfactant selected from the group consisting of an alkylphenolethoxylate of formula II and a straight-chain alkylethoxylate or secondary alkylethoxylate of formula III supra; (C) water; and (D) from about one to about two molar equivalents of an alkali metal benzoate relative to the quaternary ammonium halide. While a larger excess above about two molar equivalents of benzoate may be added, no particular advantage is gained thereby.

The di-(lower-alkyl)-long-chain-alkylbenzylammonium halides and the di-(lower-alkyl)-di-(long-chain-alkyl)-ammonium halides of formula I where $X^-$ is halide used to prepare the quaternary ammonium benzoates of the compositions are well known classes of compounds. The di-(lower-alkyl)-long-chain-alkylbenzylammonium halides include, for example, benzalkonium chloride (dimethylalkylbenzylammonium chloride) sold under the trade name Cyncal ® 80% by The Hilton-Davis Chemical Company, Cincinnati, Ohio, which consists of 80% by weight of alkyldimethylbenzylammonium chloride (50% $C_{14}$, 40% $C_{12}$ and 10% $C_{16}$ alkyl), 10% water and 10% ethanol, and myristalkonium chloride (dimethylmyristylbenzylammonium chloride), sold under the trade name Barquat ® MS-100 by Lonza Inc., Fairlawn, N.J.

The di-(lower-alkyl)-di-(long-chain-alkyl)ammonium halides of formula I above, where $R_1$ and $R_2$ are lower-alkyl, $R_3$ and $R_4$ are both $C_8$–$C_{16}$ alkyl and $X^-$ is halide, include, for example, decyldimethyloctylammonium chloride, didecyldimethylammonium chloride and dimethyldihydrogenated tallow ammonium chloride, sold under the trade names Bardac ® 2050, Bardac ® 2250 and Carosoft ® 18, respectively, by Lonza Inc.

The alkylphenolethoxylates of formula II are also well known in commerce, examples thereof being sold under the Rohm and Haas (Philadelphia, Pa.) trade names Triton ® X and Triton ® N or the GAF Corporation (Wayne, N.J. ) trade names Igepal ® CA and Igepal ® CO, and are identified by the CTFA adopted names of octoxynols and nonoxynols. These include, for example, octoxynol-7, octoxynol-10 and octoxynol-13 where R in formula II is $CH_3C(CH_3)_2CH_2C(CH_3)_2$— and x has an average value of 7, 10 and 13, respectively, and nonoxynol-7, nonoxynol-8, nonoxynol-13, etc., where R in formula II is $C_9H_{19}$ and x has an average value of 7, 8 and 13 respectively.

The straight-chain alkylethoxylates and secondary alkylethoxylates of formula III above are also commercially available. Examples thereof are sold under the Shell Chemical Company (Houston, Tex.) trade name Neodol ® 45 and are identified by the CTFA adopted name, pareth-45. Suitable members of the group for the practice of the present invention are pareth-45-7, pareth-45-11 and pareth-45-13, where $R_5$ in formula III is the residue of a mixture of synthetic $C_{14}$–$C_{15}$ alcohols and n has an average value of 7, 11 and 13 respectively.

As indicated above, the compositions of the invention can be prepared by use of di-(lower-alkyl)-long-chain-alkylbenzylammonium benzoates or di-(lower-alkyl)-di-(long-chain-alkyl)ammonium benzoates per se ($X^-$ in formula I is the benzoate anion). When so-formulated, the amounts of the quaternary ammonium benzoate of formula I and the nonionic surfactant of formulas II or III are in the range from 1 to 10 weight percent for the quaternary and from 10 to 20 weight percent for the nonionic surfactant, all amounts being based on the total weight of the composition. The compositions so-formulated can also contain an additional amount up to about 7 weight percent of an alkali metal benzoate so as to provide a total up to about 2 molar equivalents of benzoate relative to the quaternary ammonium cation.

Preferred ranges are from about 4 to 10 weight percent for the quaternary and from 12 to 17 weight percent for the nonionic surfactant, and particularly preferred amounts are about 6.4 weight percent of quaternary and about 12 weight percent of the nonionic surfactant.

Alternatively, and preferably, the compositions are prepared by forming the di-(lower-alkyl)-long-chain-alkylbenzylammonium benzoate or the di-(lower-alkyl)-di-(long-chain-alkyl)ammonium benzoate in situ by dissolving the corresponding quaternary ammonium halide and alkali metal benzoate in water. When so-formulated, it is necessary to add about one molar equivalent of an alkali metal benzoate per mole of quaternary halide. Compositions containing about a 1:1 molar equivalent ratio of alkali-metal benzoate:quaternary ammonium halide show particularly good diminution in skin irritancy, but optimal diminution is obtained at a molar equivalent ratio of these ingredients around 2:1, and such ratio is particularly preferred.

When the compositions are prepared by formation of the quaternary ammonium benzoate in situ, the amounts of the quaternary ammonium halide and the nonionic surfactant used are from about 1 to 10 weight percent of the quaternary ammonium halide and from about 10 to 20 weight percent of the nonionic surfactant, preferred amounts being about 4 to 10 weight percent of quaternary and about 12 to 17 weight percent of the nonionic surfactant, and particularly preferred amounts being about 6.4 weight percent of the quaternary and about 12 weight percent of the nonionic surfactant. Sufficient alkali metal benzoate is then added to provide a molar equivalent ratio of the benzoate to the quaternary of from about 1:1 to about 2:1. A particularly preferred composition within the ambit of the invention comprises about 4.0 weight percent sodium benzoate, about 8.0 weight percent Cyncal 80® corresponding to 6.4 weight percent of actives, about 12 weight percent Neodol® 45-7 (pareth-45-7) and the balance water.

The compositions may, in order to provide additional benefits, optionally contain non-essential ingredients such as fragrances, dyes, brighteners, other solvents such as ethanol or thickeners. Generally, fragrances may be used in amounts up to about 1.0 weight percent, dyes in amounts up to about 0.01 weight percent; brighteners in amounts up to about 0.6 weight percent; ethanol in amounts up to about 10 weight percent; and thickeners in amounts up to about 2.0 weight percent.

When the compositions are formulated from the quaternary ammonium benzoates, they may conveniently be prepared by sequential addition to water, with stirring at ambient temperature, of the nonionic surfactant, followed by the quaternary ammonium benzoate, followed by the dyes, fragrances, brighteners, solvent or thickeners, stirring being continued at each stage to effect either complete solution or homogeneous dispersion of each ingredient. When they are formulated by preparation of the quaternary ammonium benzoate in situ, they may conveniently be prepared by sequential addition to water, with stirring at ambient temperature, first of the sodium benzoate, followed by the nonionic surfactant, followed by the quaternary ammonium halide, followed by the dyes, fragrances, brighteners, solvent and thickeners, stirring being continued, as before, at each stage to effect either complete solution or homogeneous dispersion of each ingredient.

The compositions of the invention, with their diminished skin irritancy, are particularly valuable in household sanitizing and cleaning operations where the unprotected hands may be subjected to prolonged exposure for an extended period of time. They are thus particularly useful as laundry detergents and as hard surface cleaners.

The manner and process of making and using the invention, and the best mode contemplated by the inventor for carrying out the invention, will now be described so as to enable any person skilled in the art to which it pertains to make and to use the same.

EXAMPLES

Three formulations composed as follows, and prepared as described above, were prepared for test purposes:

| | Formulation (Amounts in wt %; Moles in parentheses*) | | |
|---|---|---|---|
| | A | B | C |
| CYNCAL ® (80% active) | 8.0 (0.018) | 8.0 (0.018) | 8.0 |
| Sodium benzoate | 4.0 (0.028) | 2.0 (0.014) | — |
| NEODOL ® 45-7 | 12.0 | 12.0 | 12.0 |
| Bal. $H_2O$, fragrance dye, brightener | q.s. | q.s. | q.s. |

*Moles of CYNCAL based on average molecular weight of 359.

Formulations A and b are formulated in accordance with the invention as described above and are within the ambit of the invention, whereas Formulation C was prepared for comparative purposes and is outside the scope of the invention.

Each of Formulations A, B and C, prepared as described above, was tested for skin irritancy in accordance with EPA protocols as follows:

Groups of New Zealand white rabbits of either sex weighing approximately 2 kg and about 3 months of age were used for each test formulation, 6 rabbits per group. Test animals, after being checked for good health, were maintained in steel cages and allowed food and water ad libitum for a period of 4 days prior to testing. All animals were checked once again for good health 24 hours prior to testing, and any animals in poor condition, and particularly animals with skin eruptions or dermal lesions, were rejected from the test group. They were then prepared for testing by close clipping the skin of the mid-dorsal area of the trunk between the scapulae and the pelvis, using a small animal clipper. Immediately prior to test initiation, the animals were placed in wooden restrainers, and 4 test sites, each 2.5 $cm^2$, were chosen two on each side of the vertebral column, in opposite corners of the clipped area. All sites were maintained intact during the test procedure. A single application of 0.5 ml of each test formulation was introduced to each test site under a 2.5 $cm^2$ gauze pad, and the gauze pad was fixed in place with adhesive tape. The gauze pads were removed 4 hours following application, and each test site was scored individually for erythema and for edema using the Draize skin scoring scale as follows:

| Erythema Formation | |
|---|---|
| Very slight erythema (barely perceptible) | 1 |
| Well-defined erythema | 2 |
| Moderate to severe erythema | 3 |
| Severe erythema (beet redness) to slight eschar formation (injuries in depth) | 4 |
| Total possible erythema score = 4 | |
| Edema Formation | |

-continued

| | |
|---|---|
| Very slight edema (barely perceptible) | 1 |
| Slight edema (edges of area well defined by definite raising) | 2 |
| Moderate edema (area raised approximately 1 mm) | 3 |
| Severe edema (raised more than 1 mm and extending beyond area of exposure) | 4 |
| Total possible edema score = 4 | |
| Total possible primary irritation score = 8 | |

Test sites were then reexamined at 24 and 72 hours for the same parameters, and observations were continued until all irritation had subsided or until irritation was confirmed to be irreversible. The mean scores from the 24 and 72 hour gradings for each test group were then averaged to determine a primary irritation index (P.I.I.). The lower the score thus obtained, the less irritation is the formulation. A score of 5 or more indicates a primary dermal irritant.

The results obtained with Formulations A, B and C expressed as Primary Irritation Indexes (P.I.I.), were as follows:

| Formulation | P.I.I. |
|---|---|
| A | 2.5 |
| B | 3.5 |
| C | 4.08 |

These results indicate that use of sodium benzoate with a quaternary ammonium halide in molar equivalent ratios of sodium benzoate to the quaternary halide from about 1:1 (Formulation B) to about 2:1 (Formulation A) produces significant diminution of skin irritancy over compositions formulated without sodium benzoate (Formulation C).

I claim:

1. A liquid sanitizing and cleaning composition comprising:

(A) from 1 to 10 weight percent of a quaternary ammonium benzoate of the formula:

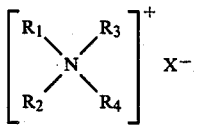

I where $R_1$ and $R_2$ are lower-alkyl groups containing from 1 to 3 carbon atoms;

$R_3$ is $C_8$–$C_{16}$ alkyl;

$R_4$ is $C_8$–$C_{16}$ alkyl or benzyl; and $X^-$ is the benzoate anion;

(B) from 10 to 20 weight percent of a nonionic surfactant selected from the group consisting of an alkylphenolethoxylate of the formula:

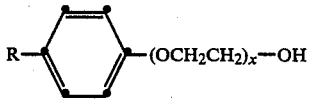

II where

R is $C_8$–$C_9$ alkyl, and x is an integer from 7 to 13, and a straight-chain alkylethoxylate or secondary alkylethoxylate of the formula:

$$H—(OCH_2CH_2)_nOR_5 \quad \text{(III)}$$

where $R_5$ is $C_{14}$–$C_{15}$ alkyl and n is an integer from 7 to 13;

(C) water; and (D) from 0 to about 7 weight percent of an alkali metal benzoate.

2. A composition according to claim 1 comprising from 1 to 10 weight percent of a di-lower-alkyl-long-chain-alkylbenzylammonium benzoate of formula I and from 10 to 20 weight percent of an alkylethoxylate of formula III.

3. A liquid sanitizing and cleaning composition comprising:

(A) from 1 to 10 weight percent of a quaternary ammonium halide of the formula:

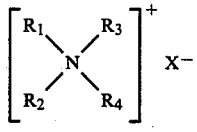

I where $R_1$ and $R_2$ are lower-alkyl groups containing from 1 to 3 carbon atoms;

$R_3$ is $C_8$–$C_{16}$ alkyl;

$R_4$ is $C_8$–$C_{16}$ alkyl or benzyl; and $X^-$ is a halide anion;

(B) from 10 to 20 weight percent of a nonionic surfactant selected from the group consisting of an alkylphenolethoxylate of the formula:

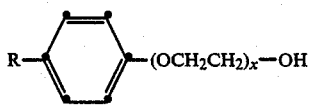

II where

R is $C_3C(CH_3)_2CH_2C(CH_3)_2$— or a mixture of branched chain isomers of the formula $C_9H_{19}$, and x is an integer from 7 to 13, and a straight-chain alkylethoxylate or secondary alkylethoxylate of the formula:

$$H—(OCH_2CH_2)_nOR_5 \quad \text{(III)}$$

where $R_5$ is $C_{14}$–$C_{15}$ alkyl and n is an integer from 7 to 13;

(C) water; and (D) from about one to about two molar equivalents of an alkali metal benzoate relative to the quaternary ammonium halide of formula I.

4. A composition according to claim 3 comprising from 1 to 10 weight percent of a di-(lower-alkyl)-long-chain-alkylbenzylammonium halide and from 10 to 20 weight percent of an alkylethoxylate of formula III.

5. A composition according to claim 3 containing from 10 to 20 weight percent of an alkylphenolethoxylate of formula II.

6. A composition according to claim 4 containing from 4 to 10 weight percent of the quaternary ammonium halide and from 12 to 17 weight percent of the alkylethoxylate.

7. A composition according to claim 5 containing from 4–10 weight percent of the quaternary ammonium halide and from 12 to 17 weight percent of the alkylphenolethoxylate.

8. A composition according to claim 6 containing 6.4 weight percent of the quaternary ammonium halide and 12 weight percent of the alkylethoxylate.

9. A composition according to claim 8 wherein the quaternary ammonium halide is dimethylalkylbenzylammonium chloride (50% $C_{14}$, 40% $C_{12}$ and 10% $C_{16}$ alkyl), the alkylethoxylate is a compound of formula III where n has an average value of 7, and which contains about 2 molar equivalents of sodium benzoate relative to the quaternary ammonium halide.

10. A composition according to claim 7 which includes one or more of a brightener, a dye, a fragrance or a thickener.

11. The method of diminishing skin irritancy in a liquid sanitizing and cleaning composition containing from 1 to 10 weight percent of a quaternary ammonium halide of the formula:

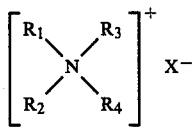

I where $R_1$ and $R_2$ are lower-alkyl groups containing from 1 to 3 carbon atoms;

$R_3$ is $C_8$–$C_{16}$ alkyl;

$R_4$ is $C_8$–$C_{16}$ alkyl or benzyl; and $X^-$ is a halide anion in combination with from 10 to 20 weight percent of a nonionic surfactant selected from the group consisting of an alkylphenolethoxylate of the formula:

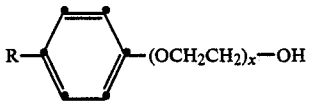

II where

R is $C_8$–$C_9$ alkyl, and x is an integer from 7 to 13, and a straight-chain alkylethoxylate or secondary alkylethoxylate of the formula:

$$H—(OCH_2CH_2)_nOR_5 \quad (III)$$

where $R_5$ is $C_{14}$–$C_{15}$ alkyl and n is an integer from 7 to 13 in an aqueous medium which comprises incorporating in such compositions from about one to about two molar equivalents, relative to the quaternary ammonium halide of formula I, of an alkali metal benzoate.

12. The method according to claim 11 wherein said composition contains from 1 to 10 weight percent of a di-(lower-alkyl)-long-chain-alkylbenzylammonium halide and from 10 to 20 weight percent of an alkylethoxylate of formula III.

13. The method according to claim 11 wherein said composition contains from 10 to 20 weight percent of an alkylphenolethoxylate of formula II.

14. The method according to claim 12 wherein about two molar equivalents of sodium benzoate relative to said quaternary ammonium halide are incorporated in said composition.

15. The method according to claim 13 wherein said composition contains from 12 to 17 weight percent of the alkylphenolethoxylate and about two molar equivalents of sodium benzoate relative to said quaternary ammonium halide are incorporated in said composition.

* * * * *